US008052428B2

(12) United States Patent
Tsao

(10) Patent No.: US 8,052,428 B2
(45) Date of Patent: Nov. 8, 2011

(54) ELASTIC SHEET STRUCTURE

(75) Inventor: Mei-Tsu Tsao, Taipei County (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 99 days.

(21) Appl. No.: 12/749,634

(22) Filed: Mar. 30, 2010

(65) Prior Publication Data

US 2010/0291810 A1 Nov. 18, 2010

(30) Foreign Application Priority Data

May 18, 2009 (CN) ..... 2009 1 0302409

(51) Int. Cl.
*H01R 12/00* (2006.01)

(52) U.S. Cl. ..... 439/66; 439/862

(58) Field of Classification Search ..... 439/66, 439/81, 862; 361/799, 816, 818; 174/351, 174/354

See application file for complete search history.

(56) References Cited

U.S. PATENT DOCUMENTS 5,092,783 A * 3/1992 Suarez et al. ..... 439/71
5,152,695 A * 10/1992 Grabbe et al. ..... 439/71
5,205,739 A * 4/1993 Malo et al. ..... 439/66
5,484,964 A * 1/1996 Dawson et al. ..... 174/261
5,600,092 A * 2/1997 Patscheck et al. ..... 174/351
5,969,952 A * 10/1999 Hayashi et al. ..... 361/774
5,984,692 A * 11/1999 Kumagai et al. ..... 439/66
6,065,980 A * 5/2000 Leung et al. ..... 439/92
6,149,443 A * 11/2000 Moran ..... 439/66
6,194,097 B1 * 2/2001 Nelson et al. ..... 429/121
6,280,254 B1 * 8/2001 Wu et al. ..... 439/630
6,398,559 B2 * 6/2002 Tanaka ..... 439/66
6,423,915 B1 * 7/2002 Winter ..... 200/292
6,493,241 B1 * 12/2002 Horng ..... 361/818
6,626,708 B2 * 9/2003 Phillips ..... 439/700
6,627,813 B2 * 9/2003 Chen ..... 174/390
6,863,547 B2 * 3/2005 Park ..... 439/95
6,898,087 B1 * 5/2005 Chen ..... 361/804
6,945,800 B2 * 9/2005 Weight et al. ..... 439/136
6,986,669 B2 * 1/2006 Kawai ..... 439/66
7,189,079 B2 * 3/2007 Noda et al. ..... 439/66
7,220,152 B2 * 5/2007 Jeong ..... 439/862
7,744,384 B2 * 6/2010 Wu ..... 439/95
7,972,186 B2 * 7/2011 Tsao ..... 439/876
7,989,045 B2 * 8/2011 Chang ..... 428/98

* cited by examiner

*Primary Examiner* — Neil Abrams
(74) *Attorney, Agent, or Firm* — Altis Law Group, Inc.

(57) ABSTRACT

An elastic sheet structure includes a fixed section, a resisting section, an elastic section, a guiding section and an engaging section. The elastic section is located between the fixed section and the resisting section and connects the fixed section to the resisting section respectively. The guiding section connects to the fixed section and has a guiding arm. The engaging section connects to the resisting section and includes an engaging wall, the engaging wall defines a notch and forms an extending wall. The guiding arm engages with the notch, and the extending wall is parallel with and abuts against the guiding arm.

17 Claims, 4 Drawing Sheets

ELASTIC SHEET STRUCTURE

BACKGROUND

1. Technical Field

The disclosure relates to elastic sheet structures; and particularly to an elastic sheet structure used in a portable electronic device to eliminate static electricity.

2. Description of Related Art

Electronic components used in portable electronic devices are usually sensitive to static electricity. The static electricity needs to be eliminated, which can be achieved by using an elastic sheet structure to connect the electronic components to a grounding portion of a circuit board.

FIG. 1 shows a Z-shaped elastic sheet structure 500 including a fixed plate 501, a resisting plate 502, and an elastic wall 503 connecting the fixed plate 501 and the resisting plate 502. The elastic wall 503 is slanted to the fixed plate 501 and the resisting plate 502. The fixed plate 501 is secured to the circuit board. The resisting plate 502 has a contacting dot 5021 for contacting an electronic component. When the resisting plate 502 is pressed along direction A, the elastic wall 503 bends, and the resisting plate 502 is moved toward the fixed plate 501. The contacting dot 5021 will simultaneously move along direction B, enabling a contacting surface of the electronic component to electronically contact the contacting dot 5021. However, it is difficult to maintain constant contact between the contacting dot 5021 and the electronic component.

Therefore, there is room for improvement within the art.

BRIEF DESCRIPTION OF THE DRAWINGS

Many aspects of the present elastic sheet structure can be better understood with reference to the following drawings. The components in the various drawings are not necessarily drawn to scale, the emphasis instead being placed upon clearly illustrating the principles of the present disclosure. Moreover, in the drawings, like reference numerals designate corresponding parts throughout the diagrams.

DETAILED DESCRIPTION

Figure 1:
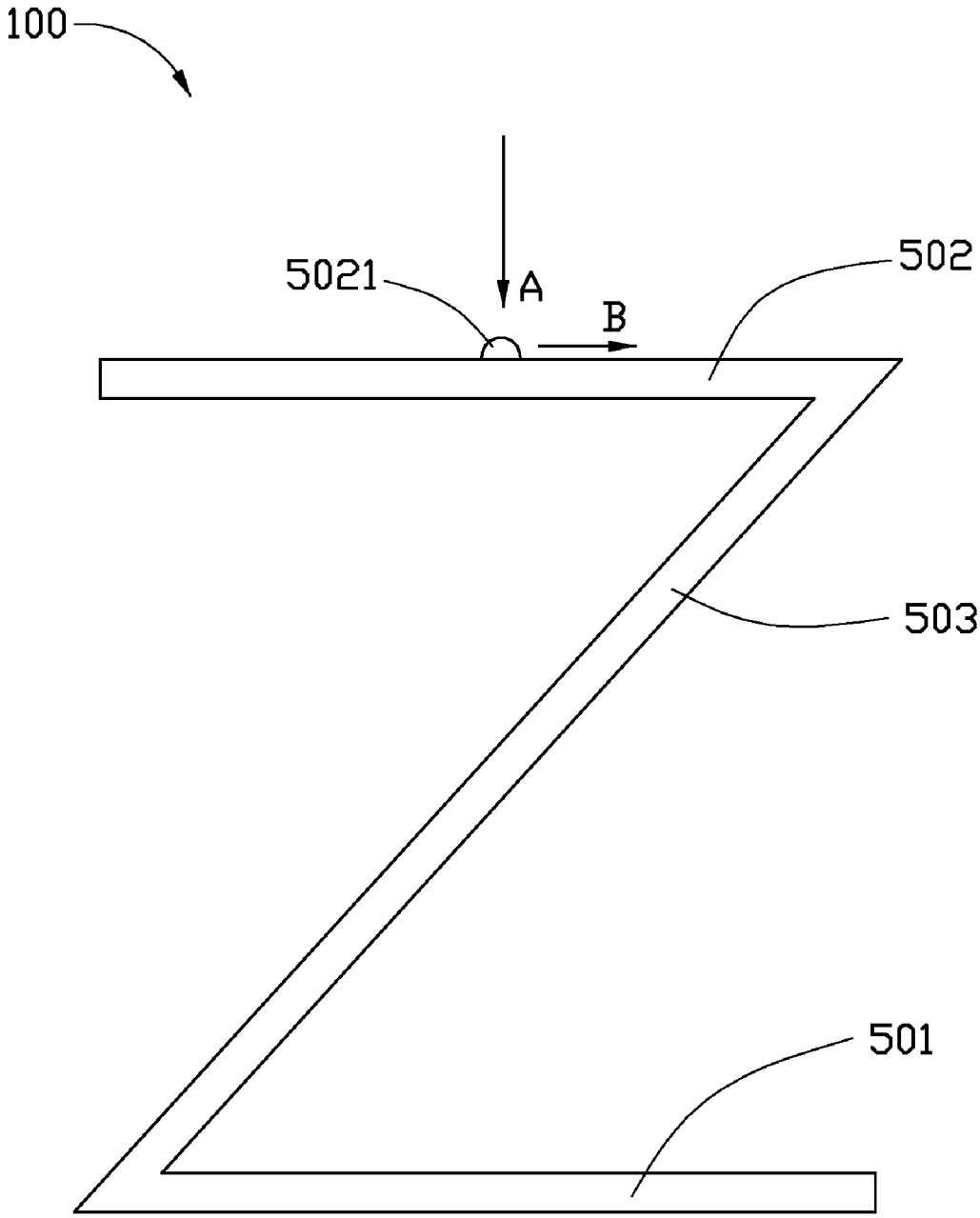
FIG. 1 (RELATED ART)
FIG. 1 is sectional view of a typical elastic sheet structure.
Figure 2:
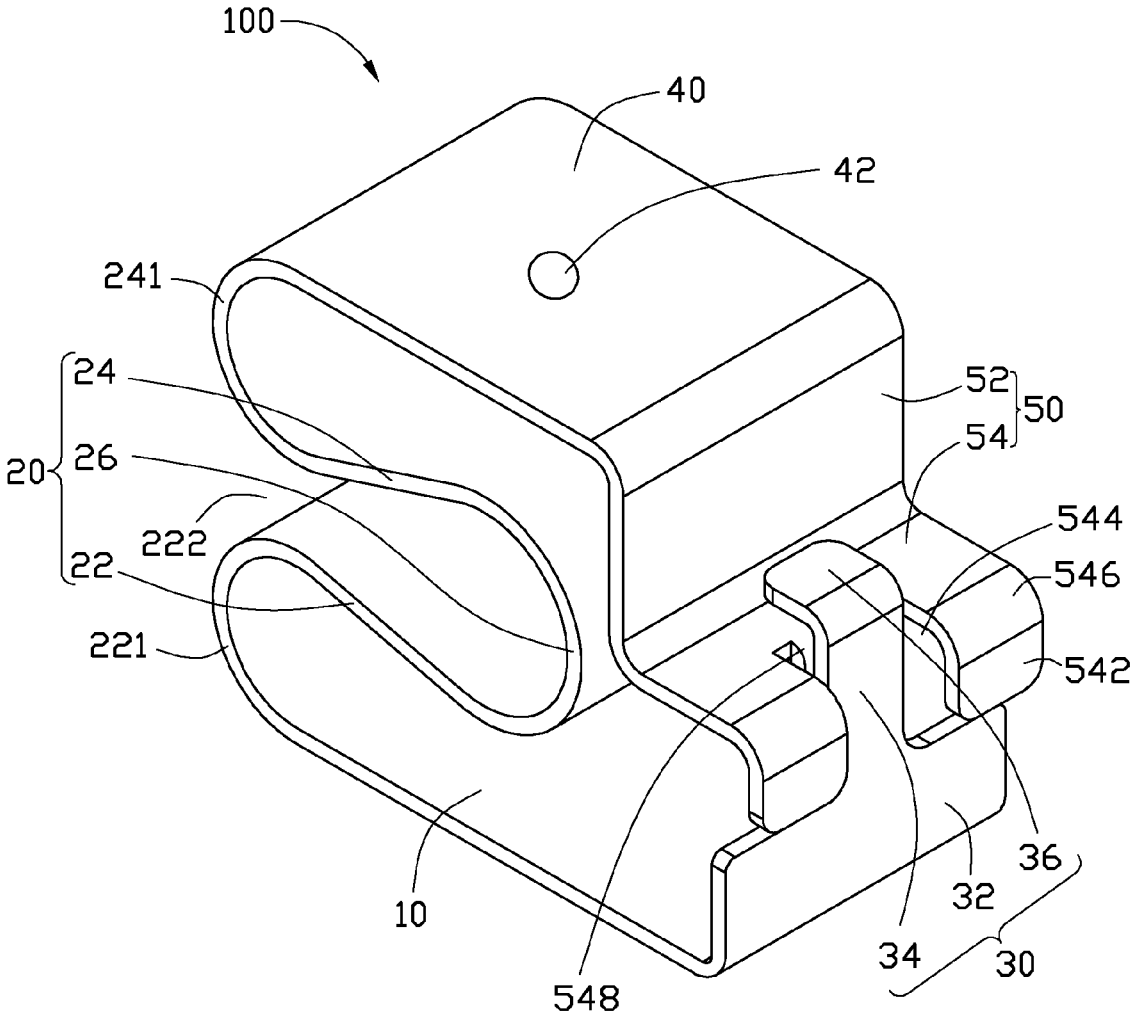
FIG. 2 is an oblique view of an elastic sheet structure of the disclosure.
Figure 3:
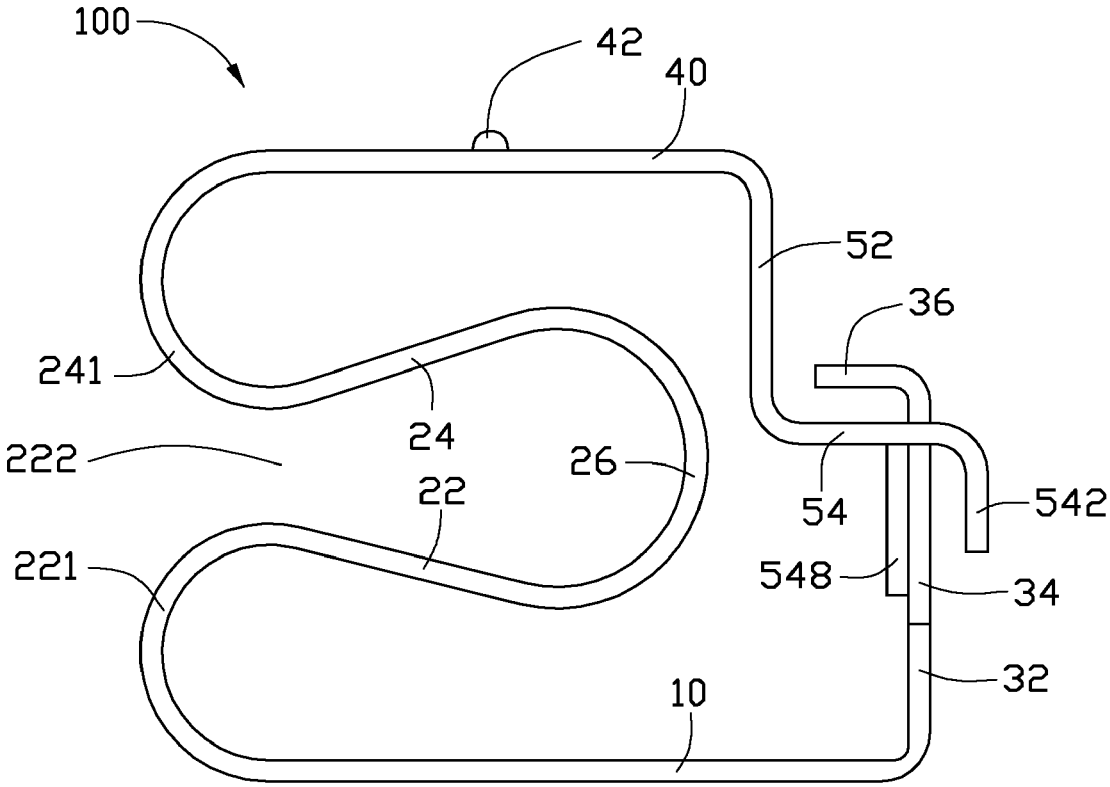
FIG. 3 is a side view of the elastic sheet structure shown in FIG. 2.

The elastic sheet structure of the disclosure can be used in a portable electronic device such as a mobile phone, personal digital assistant, etc. FIGS. 2 and 3 show the exemplary elastic sheet structure 100 made of a metallic material. The elastic sheet structure 100 includes a fixed section 10, an elastic section 20, a guiding section 30, a resisting section 40, and an engaging section 50.

The fixed section 10 connects the elastic section 20 to the guiding section 30. The fixed section 10 is configured to be affixed to a circuit board.

The elastic section 20 is located between the fixed section 10 and the resisting section 30. The elastic section 20 connects to an end of the fixed section 10 and an end of the resisting section 40. The elastic section 20 is generally U-shaped and includes a first elbow portion 22, a second elbow portion 24, and a connecting elbow portion 26. The first elbow portion 22 connects to an end of the fixed section 10, forming a first arc portion 221. The second elbow portion 24 connects to an end of the resisting section 40, forming a second arc portion 241. The second arc portion 241 is symmetrical with the first arc portion 221. The connecting elbow portion 26 is arc-shaped and located adjacent to the guiding section 30. The connecting elbow portion 26 connects the first elbow portion 22 to the second elbow portion 24. Accordingly, the first elbow portion 22, a second elbow portion 24, and the connecting elbow portion 26 define an opening 222 between the first arc portion 221 and the second arc portion 241.

The guiding section 30 is formed at the other end of the fixed section 10 and is perpendicular to the fixed section 10. The guiding section 30 includes a main wall 32, a guiding arm 34, and an end 36. The main wall 32 perpendicularly connects to the fixed section 10. The guiding arm 34 extends up from the top side of the main wall 32 and forms two supporting surfaces 322. The end 36 is formed at the tail end of the guiding arm 34 in a direction parallel to the fixed section 10.

The resisting section 40 is rectangular and parallel with the fixed section 10. The resisting section 40 engages with an electronic component. The resisting section 40 has a contact dot 42 on the top surface for contacting the electronic component.

The engaging section 50 is generally L-shaped, including a connecting wall 52 and an engaging wall 54. The connecting wall 52 connects to the other end of the resisting section 40 and is perpendicular with the resisting section 40. The engaging wall 54 connects to the other end of the connecting wall 52 and is parallel with the fixed section 10. The engaging wall 54 has a flange 542 at the tail end. The flange 542 is parallel with the main wall 32 of the guiding section 30. The engaging wall 54 defines a notch 544 running though the flange 542 and forms two curved portions 546. The notch 544 engages with the guiding arm 34 of the guiding section 30. The curved portions 546 are located above the main wall 32 of the guiding section 30 and are used to engage with the main wall 32. The notch 544 has an extending wall 548 at the bottom. The extending wall 548 extends along the guiding arm 34 and abuts the guiding arm 34. Accordingly, the guiding arm 34 can be guided along the extending wall 548 when the resisting section 40 is pressed down. The end 36 of the guiding section 30 is located above the engaging wall 54 and faces towards the connecting wall 52.

Figure 4:
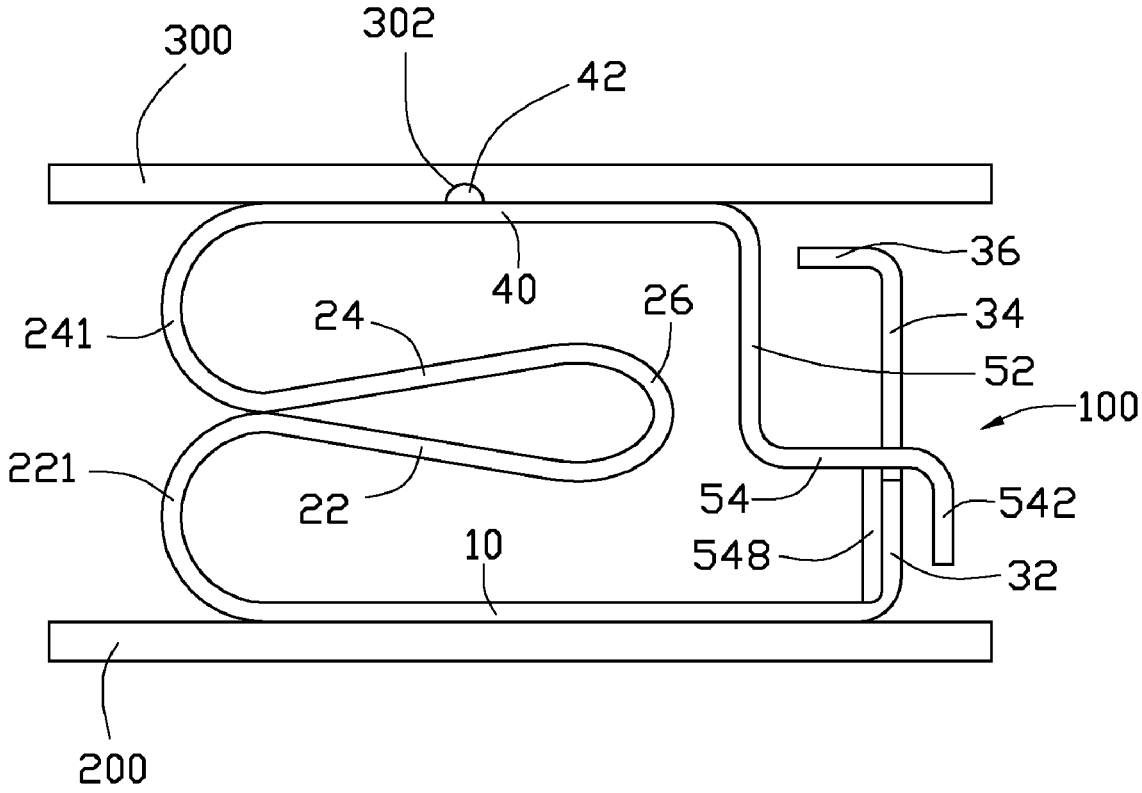
FIG. 4 is a side view of the elastic sheet structure shown in FIG. 2 after assembling.

Referring to FIG. 4, the elastic sheet structure 100 is positioned between a circuit board 200 and an electronic component 300. The fixed section 10 is secured to the circuit board 200. The electronic component 300 has a curved recess 302 to receive the contacting dot 42 of the resisting section 40. During assembly, the resisting section 40 can be pressed by the electronic component 300, at the same time, the spring section 20 is compressed and the opening 222 is closed. The extending wall 548 of the engaging section 50 slides along the guiding arm 34 of the guiding section 30 until the engaging wall 54 resists against the two supporting surfaces 322 of the main wall 32. Thus, the resisting section 40 cannot move relative to the electronic component 300, and the contacting dot 42 cannot slide out from the recess 302. The resisting section 40 can maintain contact with the electronic component 300. When the electronic component 300 is removed, the elastic section 20 is released, and the resisting section 40 and the engaging section 50 move up. The extending wall 548 of the engaging section 50 slides along the guiding arm 34 of the guiding section 30. The resisting section 40 and the engaging section 50 return to the original position. In this case, the end 36 can limit the return movement of the engaging wall 54 and the resisting section 40.

It is to be understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An elastic sheet structure, comprising:

a fixed section for fixing with a circuit board;

a resisting section for resisting with an electronic component;

an elastic section connecting the fixed section to the resisting section;

wherein the elastic sheet structure further includes a guiding section and an engaging section, the guiding section connects to the fixed section and has a guiding arm, the engaging section connects to the resisting section and includes an engaging wall, the engaging wall defines a notch and forms an extending wall, the guiding arm engages with the notch, and the extending wall is parallel with the guiding arm and abuts against the guiding arm.

2. The elastic sheet structure as claimed in claim 1, wherein the guiding section connects to an end of the fixed section and is perpendicular with the fixed section, the guiding section includes a main wall and the guiding arm, the guiding arm extends upwardly from the main wall and forms two supporting surfaces.

3. The elastic sheet structure as claimed in claim 1, wherein engaging section includes a connecting wall, the connecting wall connects the resisting section to the engaging wall, the connecting wall is perpendicular with the resisting section and the engaging wall.

4. The elastic sheet structure as claimed in claim 2, wherein the engaging wall has a flange defining the notch and forms two curved portions, the curved portions are above the main wall and engage with the two supporting surfaces respectively.

5. The elastic sheet structure as claimed in claim 4, wherein the extending wall is formed at the bottom of the notch and parallel with the flange.

6. The elastic sheet structure as claimed in claim 1, wherein the elastic section is located between the fixed section and the resisting section, the two ends of the elastic section connect to the fixed section and the resisting section respectively.

7. The elastic sheet structure as claimed in claim 1, wherein the elastic section includes a first elbow portion, a second elbow portion and a connecting elbow portion connecting the first elbow portion to the second elbow portion respectively, the first elbow portion, the second elbow portion and the connecting elbow portion define an opening.

8. The elastic sheet structure as claimed in claim 1, wherein the resisting section is parallel with the fixed section, the resisting section has a contacting dot on the top surface, the contacting dot is used to contact the electronic component.

9. An elastic sheet structure, comprising:

a fixed section for fixing with a circuit board;

a resisting section for resisting with an electronic component;

an elastic section connecting the fixed section to the resisting section;

a guiding section connecting to an end of the fixed section, the guiding section having a main wall and a guiding arm extending from the main wall; and an engaging section connecting to an end of the resisting section, the engaging section including an engaging wall above the main wall, the engaging wall defining a notch and forming an extending wall;

wherein the notch receives the guiding arm therein, the extending wall is parallel with the guiding arm and leans on the guiding arm, the engaging wall can be resisted by the main wall.

10. The elastic sheet structure as claimed in claim 9, wherein the guiding section includes an end, the end is formed at the end of the guiding arm and parallel with the fixed section.

11. The elastic sheet structure as claimed in claim 9, wherein the main wall of the guiding section is perpendicular to the fixed section, the guiding arm extends upwardly from the main wall and forms two supporting surfaces.

12. The elastic sheet structure as claimed in claim 9, wherein engaging section includes a connecting wall, the connecting wall connects with an end of the resisting section and an end of the engaging wall, the connecting wall is perpendicular to the resisting section and the engaging wall.

13. The elastic sheet structure as claimed in claim 10, wherein the engaging wall has a flange defining the notch and forms two curved portions, the curved portions are above the main wall and engage with the two supporting surfaces respectively.

14. The elastic sheet structure as claimed in claim 13, wherein the extending wall is formed at the bottom of the notch and parallel with the flange.

15. The elastic sheet structure as claimed in claim 9, wherein the elastic section is located between the fixed section and the resisting section, the two ends of the elastic section connects with the fixed section and the resisting section respectively.

16. The elastic sheet structure as claimed in claim 9, wherein the elastic section includes a first elbow portion, a second elbow portion and a connecting elbow portion connecting with the first elbow portion and the second elbow portion respectively, the first elbow portion, the second elbow portion and the connecting elbow portion define an opening.

17. The elastic sheet structure as claimed in claim 9, wherein the resisting section is parallel with the fixed section, the resisting section has a contacting dot on the top surface, the contacting dot is used to contact the electronic component.

* * * * *